US008128378B2

(12) United States Patent
Rowan et al.

(10) Patent No.: US 8,128,378 B2
(45) Date of Patent: Mar. 6, 2012

(54) DUAL MODE COMPENSATION FOR VARIABLE DISPLACEMENT PUMP FLUID METERING SYSTEM

(75) Inventors: William Scott Rowan, South Bend, IN (US); Larry Portolese, Granger, IN (US); Brad McRoberts, Mishawaka, IN (US); George Wieger, Niles, MI (US)

(73) Assignee: Honeywell International Inc., Morristown, NJ (US)

( * ) Notice: Subject to any disclaimer, the term of this patent is extended or adjusted under 35 U.S.C. 154(b) by 1402 days.

(21) Appl. No.: 11/943,755

(22) Filed: Nov. 21, 2007

(65) Prior Publication Data

US 2009/0031821 A1 Feb. 5, 2009

Related U.S. Application Data

(60) Provisional application No. 60/952,717, filed on Jul. 30, 2007.

(51) Int. Cl.

| | |
|---|---|
| ***F04B 1/26*** | (2006.01) |
| ***F04B 49/00*** | (2006.01) |
| ***F01B 9/02*** | (2006.01) |
| ***F02C 9/30*** | (2006.01) |

(52) U.S. Cl. ..... 417/222.1; 417/297; 92/13; 60/39.281; 60/734

(58) Field of Classification Search ..... 417/213, 417/222.1, 297; 92/13; 60/39.281, 734
See application file for complete search history.

(56) References Cited

U.S. PATENT DOCUMENTS

| | | | | |
|---|---|---|---|---|
| 3,286,601 | A * | 11/1966 | Jones | 91/434 |
| 3,990,237 | A | 11/1976 | Van Gerpen | |
| 4,208,874 | A | 6/1980 | Field, Jr. | |
| 4,366,672 | A * | 1/1983 | Claar et al. | 60/452 |
| 4,381,176 | A * | 4/1983 | Kouns et al. | 417/222.1 |
| 4,429,528 | A | 2/1984 | Matthews et al. | |
| 4,624,106 | A * | 11/1986 | Mickelson et al. | 60/452 |
| 5,133,181 | A | 7/1992 | Moore, Jr. | |
| 5,448,882 | A | 9/1995 | Dyer et al. | |
| 5,515,829 | A * | 5/1996 | Wear et al. | 123/446 |
| 5,709,079 | A | 1/1998 | Smith | |
| 6,102,001 | A | 8/2000 | McLevige | |
| 6,189,312 | B1 | 2/2001 | Smith | |
| 6,205,766 | B1 | 3/2001 | Dixon et al. | |
| 6,401,446 | B1 | 6/2002 | Gibbons | |
| 6,412,271 | B1 | 7/2002 | Maker et al. | |
| 6,578,353 | B2 | 6/2003 | Maillard et al. | |
| 6,813,876 | B2 | 11/2004 | Griffiths et al. | |
| 6,962,485 | B2 | 11/2005 | Bennett et al. | |
| 6,981,359 | B2 | 1/2006 | Wernberg et al. | |
| 7,234,293 | B2 | 6/2007 | Yates et al. | |
| 2002/0066266 | A1 * | 6/2002 | Maker et al. | 60/39.281 |
| 2005/0284148 | A1 * | 12/2005 | Wernberg et al. | 60/734 |

* cited by examiner

*Primary Examiner* — Charles Freay
(74) *Attorney, Agent, or Firm* — Ingrassia Fisher & Lorenz, P.C.

(57) ABSTRACT

A system and method is provided for controlling a variable displacement piston pump that supplies fluid to one or more loads. If fluid is being supplied through a metering valve to a load, then the variable displacement piston pump is controlled to operate in accordance with a variable flow/variable discharge pressure scheme. However, if fluid is not being supplied through the metering valve to the load, then the variable displacement piston pump is controlled to operate in accordance with a variable flow/constant discharge pressure scheme.

17 Claims, 3 Drawing Sheets

DUAL MODE COMPENSATION FOR VARIABLE DISPLACEMENT PUMP FLUID METERING SYSTEM

CROSS-REFERENCE TO RELATED APPLICATION

This application claims the benefit of U.S. Provisional Application No. 60/952,717, filed Jul. 30, 2007.

TECHNICAL FIELD

The present invention generally relates to fluid metering systems and, more particularly, to fluid metering systems that supply minimal waste heat input into the system.

BACKGROUND

Typical gas turbine engine fuel supply systems include a fuel source, such as a fuel tank, and one or more pumps that draw fuel from the fuel tank and deliver pressurized fuel to the fuel manifolds and fuel nozzles in the engine combustor via a main supply line. The main supply line may include one or more valves in flow series between the pumps and the fuel manifolds. These valves generally include at least a metering valve and a pressurizing-and-shutoff valve downstream of the metering valve. In some systems, three pumps are used to deliver pressurized fuel. These pumps may include an aircraft or tank level pump, a boost pump, and a high pressure pump. The boost pump is typically a centrifugal pump and the high pressure pump is typically a gear pump, though in some applications the high pressure pump may also be a centrifugal pump.

Most fuel supply systems are controlled based on the principle that fuel flow is directly proportional to the product of the metering valve area and the square root of the pressure drop across the metering valve. There are some exceptions to this control scheme, such as systems that are based on direct volumetric delivery of fuel. Given the fundamental physics of controlling fuel flow by varying metering valve area and maintaining the pressure drop across the metering valve, the method of varying the area results in moving or displacing a valve in a manner that results in flow area varying exponentially. The manner in which pressure drop is typically controlled depends on whether the high pressure pump is a gear pump or a centrifugal pump. Nonetheless, the high pressure pump is sized to have some excess flow capability at all times.

If the high pressure pump is a gear pump, then the fuel supply system typically includes some type of bypass subsystem maintain the pressure drop across the metering valve and to recirculate excess flow back to the inlet of the high pressure pump. This flow recirculation puts more work into the fuel, thereby increasing its temperature. In some systems, this temperature increase may be in the range of 20-60° F. If the high pressure pump is a centrifugal pump, the metering valve pressure drop is controlled by throttling flow, choking, or otherwise restricting the output of the pump. This also typically results in increased fuel temperature, as more work is being put into the fuel.

Fuel supply systems that use a variable displacement piston pump to regulate flow across a metering valve typically have two operational modes: normal mode and shutoff mode. During normal mode operation, the system supplies fuel to the engine combustor as a function of metering valve flow area. The variable displacement piston pump provides flow to the metering valve to maintain the pressure drop across the metering valve. Since engine nozzle backpressure is a function of metered flow, the discharge pressure of the variable displacement piston pump varies as a function of metered flow to insure a constant pressure drop across the metering valve. Hence, during normal mode operation the variable displacement piston pump operates in accordance with a variable discharge pressure, variable flow scheme. During shutoff mode operation, a shutoff valve is closed, thereby terminating fuel flow to the nozzles; however, the variable displacement piston pump may still be driven. As a result the pump may be driven to maximum displacement and flow. This in turn may cause the system to bypass flow to a pressure relief valve, dumping a great deal of waste heat into the system.

Each of the aforementioned fuel supply system architectures exhibit an unwanted fuel temperature increase. In modern engine and airframe environment, fuel may also be used as a heat sink for the engine oil and other aircraft heat loads, such as environmental controls, electric power generation, and others. It is desirable from a thermodynamic point of view to transfer as much of the waste heat from these heat loads into the fuel as is possible so that the engine turbines can extract that energy. However, in many instances the waste heat from these heat loads exceeds the capacity for the fuel, without overheating the fuel. It is thus becoming increasingly desirable to minimize the self-heating of the fuel system.

Hence, there is a need for a gas turbine engine fuel supply system that includes a variable displacement piston pump that may be operated in an alternative mode, other than variable discharge pressure/variable flow, during shutoff mode operation of the system. The present invention addresses at least this need. There is also a need for a fuel supply system that minimizes the self-heating of the fuel, and thereby provides a thermodynamically efficient architecture.

BRIEF SUMMARY

In one embodiment, and by way of example only, a fluid supply system includes a variable displacement piston pump, a hanger actuator, and a pump compensator. The variable displacement piston pump includes an adjustable hanger that is movable to a plurality of control positions. The variable displacement piston pump is configured to receive a drive torque and, upon receipt of the drive torque, to supply fluid at a pump discharge pressure and flow rate dependent on the control position of the adjustable hanger. The hanger actuator includes a pump control pressure inlet port coupled to receive pump control fluid at a fluid pressure. The hanger actuator is responsive to the fluid pressure of the pump control fluid to move the adjustable hanger to a control position. The pump compensator includes a mode control pressure port and a pump control pressure outlet port. The pump compensator pump control pressure outlet port is in fluid communication with the hanger actuator pump control pressure inlet port. The pump compensator is responsive to fluid pressure at the mode control pressure port to operate in either a normal mode or a shutdown mode. In the normal mode the pump compensator controls the fluid pressure of the pump control fluid such that the variable displacement piston pump is controlled in accordance with a variable flow/variable discharge pressure scheme. In the shutdown mode, the pump compensator controls the fluid pressure of the pump control fluid such that the variable displacement piston pump is controlled in accordance with a variable flow/constant discharge pressure scheme.

In another exemplary embodiment, a fluid supply system includes a variable displacement piston pump, a hanger actuator, and a pump compensator. The variable displacement piston pump includes an adjustable hanger that is movable to a plurality of control positions. The variable displacement piston pump is configured to receive a drive torque and, upon receipt of the drive torque, to supply fluid at a pump discharge pressure and flow rate dependent on the control position of the adjustable hanger. The hanger actuator includes a pump control pressure inlet port coupled to receive pump control fluid at a fluid pressure. The hanger actuator is responsive to the fluid pressure of the pump control fluid to move the adjustable hanger to a control position. The pump compensator includes a mode control pressure port and a pump control pressure outlet port. The pump compensator pump control pressure outlet port is in fluid communication with the hanger actuator pump control pressure inlet port. The pump compensator is responsive to fluid pressure at the operational mode pressure port to operate in either a normal mode or a shutdown mode. The pump compensator includes a mode control valve and a compensator valve. The mode control valve is responsive to fluid pressure at the mode control pressure port to move between a normal mode position and a shutdown mode position. The compensator valve is in fluid communication with the mode control valve and is operable to control the fluid pressure of the pump control fluid such that when the mode control valve is in the normal mode position, the variable displacement piston pump is controlled in accordance with a variable flow/variable discharge pressure scheme, and when the mode control valve is in the shutdown mode position, the variable displacement piston pump is controlled in accordance with a variable flow/constant discharge pressure scheme.

In yet another exemplary embodiment, a method of controlling a variable displacement piston pump that supplies fuel to a gas turbine engine includes determining whether fuel is being supplied to the gas turbine engine. The variable displacement piston pump is controlled to operate in accordance with a variable flow/variable discharge pressure scheme if fuel being supplied to the gas turbine engine, and the variable displacement piston pump is controlled to operate in accordance with a variable flow/constant discharge pressure scheme if fuel is not being supplied to the gas turbine engine.

BRIEF DESCRIPTION OF THE DRAWINGS

The present invention will hereinafter be described in conjunction with the following drawing figures, wherein like numerals denote like elements, and wherein.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding background of the invention or the following detailed description of the invention. In this regard, although an embodiment of the invention is described as being implemented in an aircraft, it will be appreciated that the invention may be implemented in numerous and varied end-use environments where fuel flow to a gas turbine engine is controlled. Moreover, the invention is not limited to use as a fuel supply system, but may be used in numerous systems to delivered a meter flow of fluid to one or more loads.

Figure 1:
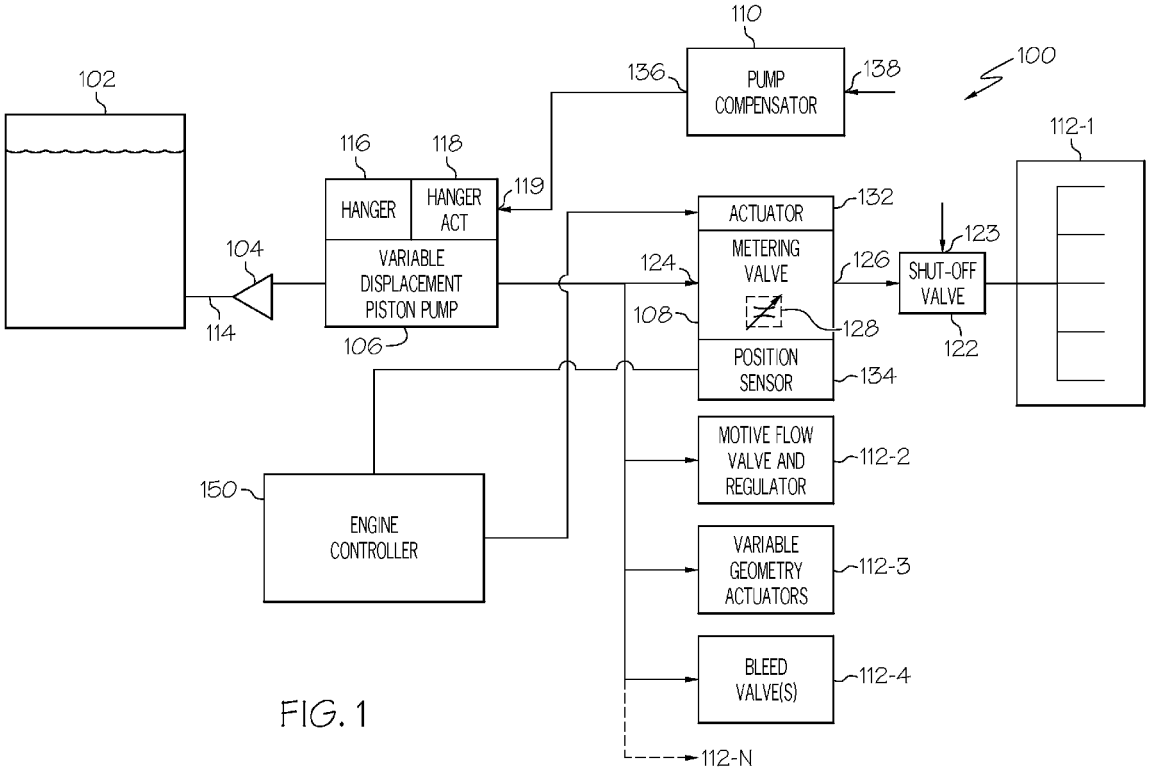
FIG. 1 is a simplified schematic diagram of an exemplary embodiment of a fuel delivery and control system for a gas turbine engine.

Turning now to FIG. 1, a simplified schematic diagram of one embodiment of a fuel delivery and control system for a gas turbine engine, such as a turbofan jet aircraft engine, is depicted. The system 100 includes a fuel source 102, one or more pumps 104, 106, metering valve 108, a pump compensator 110 and an engine controller 150. The fuel source 102, which is preferably implemented as one or more tanks, stores fuel that is to be supplied to a plurality of fuel loads 112 (e.g. 112-1, 112-2, 112-3, . . . 112-N). It will be appreciated that the number and type of fuel loads may vary, and may include one or more of a gas turbine engine combustor zone and associated nozzles 112-1, a motive flow valve and regulator 112-2, one or more variable geometry actuators 112-3, and one or more bleed valves 112-4, just to name a few.

A supply line 114 is coupled to the fuel source 102 and, via the just-mentioned pumps 104, 106, delivers the fuel to the fuel loads 112. It is noted that the supply line 114 is, for convenience, depicted and described with a single reference numeral. However, it will be appreciated that the system 100 is implemented using separate sections of piping, though a single section is certainly not prohibited. As FIG. 1 further depicts, a shutoff valve 122 is disposed in the supply line 114 downstream of the pumps 104, 106. The shutoff valve 122 is movable between an open position and a closed position. In the depicted embodiment, the shutoff valve 122 is a hydraulically operated valve. In this regard, the depicted shutoff valve 122 includes a position control pressure port 123 that is at least selectively in fluid communication with a fluid pressure source. The shutoff valve 122 is responsive to the fluid pressure at the position control pressure port 123 to move between the open and closed positions. It will be appreciated that in some embodiments the shutoff valve may also function to ensure there is a minimum system pressure magnitude in portions of the supply line 114, and to shut when the pressure falls below this minimum pressure magnitude.

Each of the one or more pumps 104, 106 is positioned in flow-series in the supply line 114 and take a suction on the fuel source 102. In the depicted embodiment, two engine-driven pumps are used and include a boost pump 104, such as a relatively low horsepower centrifugal pump, and a high pressure pump 106, such as a variable displacement piston pump. The boost pump 104 takes a suction directly on the fuel source 102 and provides sufficient suction head for the high pressure pump 106. The high pressure pump 106, a preferred embodiment of which will now be described, then supplies the fuel at a relatively high pressure to the remainder of the supply line 114. Although not depicted, it will be appreciated that the system 100 may additionally include a low pressure pump with the fuel tank(s) 102 to supply fuel to the boost pump 104.

The high pressure pump 106, as noted above, is preferably a variable displacement piston pump, and includes an adjustable hanger 116, and a hanger actuator 118. As is generally known, a variable displacement piston pump can be adjusted to increase or decrease the amount of fuel it supplies. More specifically, the adjustable hanger 116, or swash plate as it is sometimes referred to, is coupled to a plurality of non-illustrated pistons that are disposed, one each, in a plurality of non-illustrated cylinders. The stroke of the pistons in the cylinders, and thus the flow rate of the variable displacement piston pump 106, is varied by varying the position of the adjustable hanger 116. The position of the adjustable hanger 116 is varied by the hanger actuator 118. The hanger actuator 118 includes a pump control pressure inlet port 119 that is in fluid communication with, and thus receives pump control fluid from, the pump compensator 110. As will be described in more detail further below, the hanger actuator 118 is responsive to fluid pressure variations of the pump control fluid to move the adjustable hanger 116.

The metering valve 108 is positioned in flow-series in the supply line 114 downstream of the variable displacement piston pump 106 and upstream of the shutoff valve 122. The metering valve 108 includes an inlet port 124, and outlet port 126, a variable area flow orifice 128, and an actuator 132. A portion of the fuel in the supply line 114 flows into the metering valve inlet port 124, through the variable area flow orifice 128, and out the metering valve outlet port 126. The metering valve actuator 132 is used to adjust the position of the metering valve 108, and thus the area of the variable area flow orifice 128. In the depicted embodiment, the metering valve 108 is a hydraulically-operated valve and the metering valve actuator 132 is an electro-hydraulic servo valve (EHSV) that is used to adjust the position of the metering valve 108 by controlling the flow of operational hydraulic fluid to the metering valve 108. It will be appreciated, however, that this is merely exemplary of a particular embodiment, and that the metering valve 108 and actuator 132 may each be implemented using other types of devices. For example, the metering valve 108 could be an electrically operated valve. In this case, the metering valve actuator 132, may not be used, or it could be implemented as an independent controller. In any case, as will be described further below, fuel flow rate to the engine combustor 112-1 is controlled by adjusting the position of the metering valve 108, and thus the area of the variable area flow orifice 128, via the metering valve actuator 132.

As FIG. 1 also depicts, a position sensor 134 is coupled to the metering valve 108. The position sensor 134 is configured to sense metering valve position and supply a metering valve position signal to the engine controller 150. The position of the metering valve 108 is directly related to the area of the variable area flow orifice 128, which is directly related to the fuel flow rate to the combustor 112-1. The position sensor 134 is preferably a dual channel linear variable differential transformer (LVDT), but could be any one of numerous position sensing devices known in the art. For example, the position sensor 134 could be a rotary variable differential transformer (RVDT), an optical sensor, a potentiometer sensor, or the like.

The pump compensator 110 is in fluid communication with the hanger actuator 118 and, as previously noted, supplies pump control fluid to the hanger actuator 118. The pump compensator 110 includes at least a pump control pressure outlet port 136 and a mode control pressure port 138. The pump control pressure outlet port 136 is in fluid communication with, and supplies the pump control fluid to, the hanger actuator pump control pressure inlet port 119. The mode control pressure port 138 is coupled to a non-illustrated fluid pressure source. Though not depicted in FIG. 1, it will be appreciated that in some embodiments the mode control pressure port 138 and the shutoff valve position control pressure port 123 may be coupled to the same fluid pressure source. In any case, the pump compensator 110, which is preferably a dual mode device, is configured to be responsive to fluid pressure at the mode control pressure port 138 to operate in either a normal mode or a shutdown mode. Before proceeding further, the overall operation of the pump compensator 110 in each of these modes will first be described.

In the normal mode, the pump compensator 110 controls the fluid pressure of the pump control fluid supplied to the hanger actuator 118 such the variable displacement pump supplies fuel at a rate to maintain a constant differential pressure across the metering valve 108. It is generally known that engine nozzle backpressure varies as a function of the metered flow rate through the metering valve 108 to the combustor 112-1. Hence, in order to maintain the differential pressure across the metering valve 108, the discharge pressure of the variable displacement piston pump 106 also varies as a function of metered flow. It may thus be appreciated that the pump controller 110, in the normal mode, controls the fluid pressure of the pump control fluid supplied to the hanger actuator 118 such that the variable displacement piston pump 106 is controlled in accordance with a variable flow/variable discharge pressure scheme. In the shutdown mode, the pump compensator 110 controls the fluid pressure of the pump control fluid supplied to the hanger actuator 118 such that the variable displacement piston pump 106 is controlled in accordance with a variable flow/constant discharge pressure scheme. This is because, as will be described below, the pump compensator 110 is placed in the shutdown mode when the configuration of the system 100 is such that the variable displacement piston pump 106 only needs to supply an amount of flow sufficient to make up for internal losses and, if needed or desired, to maintain sufficient pressure to supply fuel to one or more of the other fuel loads 112-2, 112-3, 112-4, . . . 112-N. A particular embodiment of the pump compensator 110 that is configured to implement this functionality will be described in greater detail further below. However, for completeness of system description, the engine controller 150 will first be briefly discussed.

The engine controller 150, which may be implemented as a Full Authority Digital Engine Controller (FADEC) or other electronic engine controller (EEC), controls the system 100 to operate in a normal mode or a shutdown mode. To do so, the engine controller 150 receives various input signals and, in response, controls the position of the shutoff valve 122 and the fuel flow rate to the combustor 112-1 accordingly. In particular, in the normal mode the engine controller 150 is responsive to an input from, for example, non-illustrated thrust command equipment in a non-illustrated aircraft cockpit, and to the metering valve position signal. It will be appreciated that, at least in some embodiments, the engine controller 150 may additionally receive one or more other signals, and may additionally supply control signals to one or more non-illustrated control devices associated with one or more of the other fuel loads 112-2, 112-3, 112-4, . . . 112-N.

In any case, during normal mode the engine controller 150, in response to the signals it receives, causes the fluid pressure at the shutoff valve position control pressure port 123 to be of a magnitude that causes the shutoff valve 122 to move to the open position. The engine controller 150 further causes the fluid pressure at the pump compensator mode control pressure port 138 to be of a magnitude that causes the pump compensator 110 to be configured to operate in its normal mode. The engine controller 150 additionally supplies appropriate fuel flow commands to the metering valve actuator 132. In response to the fuel flow commands, the metering valve actuator 132, as was described above, adjusts the area of the metering valve variable area flow orifice 128 to obtain the desired flow rate to the combustor 112-1. Specifically, the fuel flow rate ($W_F$) to the combustor 112-1 is controlled in accordance with the following flow equation (Equation 1):

$$W_F = K_1 \times A_{MV} \times \sqrt{\Delta P},$$

where $K_1$ is a flow constant that is a function of fuel density, fuel temperature, and metering valve discharge coefficient (CD), $A_{MV}$ is the area of the variable area flow orifice 128, which is a known function of metering valve position, and ΔP is the differential pressure across the metering valve 108. As noted above, when the pump compensator 110 is configured to operate in its normal mode, it controls the position of the adjustable hanger 116 so that a constant ΔP is maintained across the metering valve 108. Thus, since $K_1$ is a constant, the flow rate, $W_F$, is controlled by adjusting the area, A, of the metering valve variable area flow orifice 128.

In the shutdown mode, the engine controller 150 receives a suitable shutdown signal from, for example, non-illustrated equipment in the non-illustrated cockpit. In response, the engine controller 150 causes the fluid pressure at the shutoff valve position control pressure port 123 to be of a magnitude that causes the shutoff valve 122 to move to the closed position. The engine controller 150 also causes the fluid pressure at the pump compensator mode control pressure port 138 to be of a magnitude that causes the pump compensator 110 to be configured to operate in its shutdown mode. In the shutdown mode, the variable displacement piston pump 106, at least initially, is still being driven so that fuel may be supplied to one or more of the other fuel loads 112-2, 112-3, 112-4, . . . 112-N. As noted above, the pump compensator 110, in its shutdown mode, controls the fluid pressure of the pump control fluid supplied to the hanger actuator 118 such that the variable displacement piston pump 106 is controlled in accordance with a variable flow/constant discharge pressure scheme.

Figure 2:
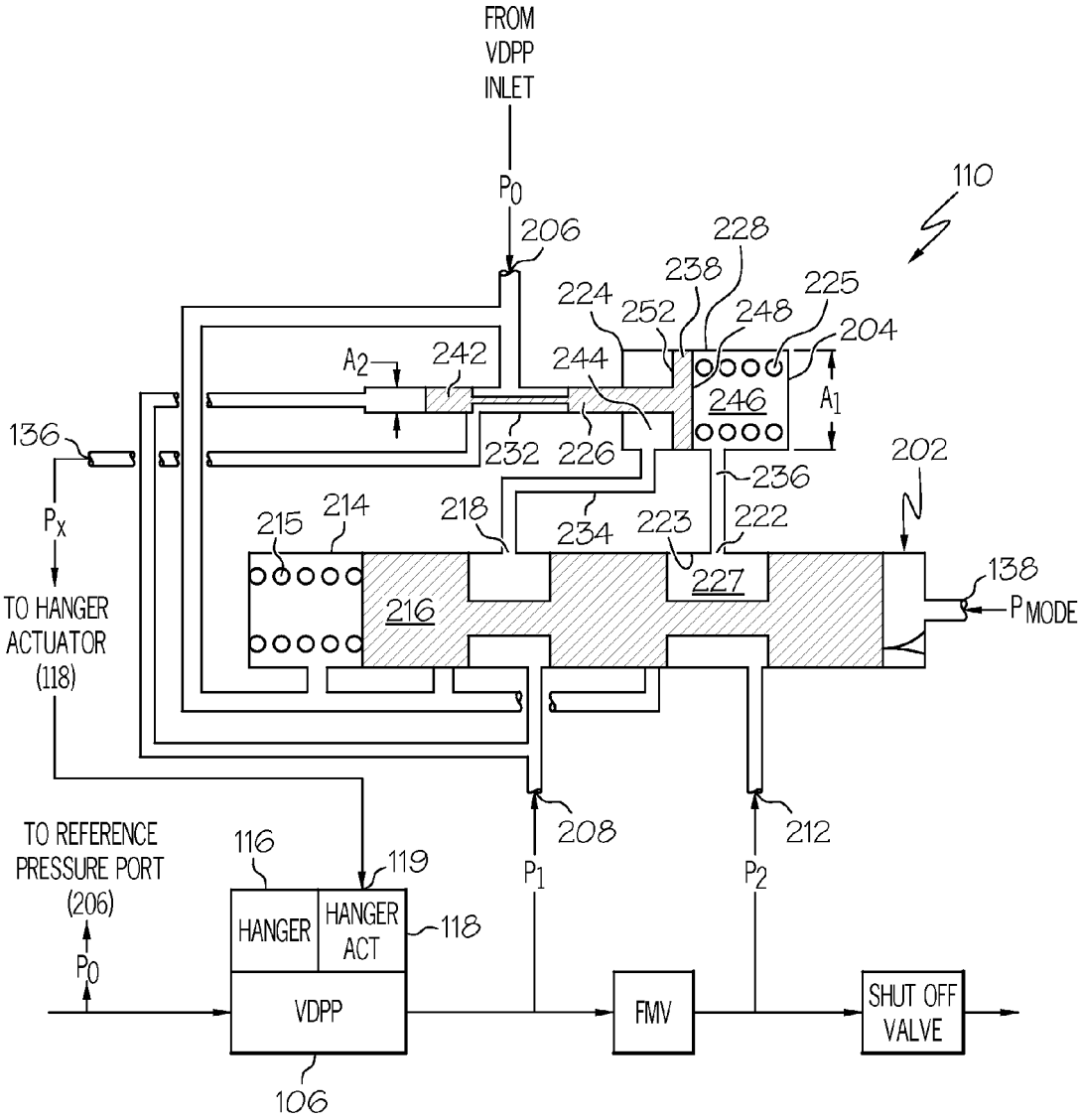
FIG. 2 is a schematic diagram of an embodiment of an exemplary dual mode pump compensator, in a normal mode, that may be included in the system of FIG. 1.

Turning now to FIG. 2, a schematic diagram of a particular embodiment of an exemplary dual mode pump compensator 110 is depicted and will now be described. The pump compensator 110 includes a mode control valve 202 and a compensator valve 204 and, in addition to the pump control pressure outlet port 136 and the mode control pressure port 138, further includes a reference pressure port 206, a first control pressure port 208, and a second control pressure port 212. The mode control valve 202 is responsive to fluid pressure at the mode control pressure port 138 to move between a normal mode position, which is the position depicted in FIG. 2, and a shutdown mode position, which is the position depicted in FIG. 3. The compensator valve 204 is in fluid communication with the mode control valve 202 and controls the fluid pressure of the pump control fluid at the pump control pressure outlet port 136, and thus at the hanger actuator pump control pressure inlet port 119, and concomitantly the control scheme of the variable displacement piston pump 106, based on the position of the mode control valve 202. Specifically, when the mode control valve 202 is in the normal mode position, the variable displacement piston pump 106 is controlled in accordance with the variable flow/variable discharge pressure scheme, and when the mode control valve 202 is in the shutdown mode position, the variable displacement piston pump 106 is controlled in accordance with the variable flow/constant discharge pressure scheme.

To implement its above-described functionality, the depicted mode control valve 202 includes a valve body 214, a shuttle valve 216, and a shuttle valve bias spring 215. The valve body 214 includes a first fluid outlet port 218, a second fluid outlet port 222, and an inner surface 223 that defines a shuttle valve chamber 227. The shuttle valve chamber 226 is in fluid communication with the mode control pressure port 138, the reference pressure port 206, the first control pressure port 208, the second control pressure port 212, the first fluid outlet port 218, and the second fluid outlet port 222. The shuttle valve 216 is movably disposed within the shuttle valve chamber 227 and is biased toward the normal mode position via a force supplied thereto from the shuttle valve bias spring 215. The shuttle valve 216 responsive to the fluid pressure ($P_{MODE}$) at the mode control pressure port 138, and the force supplied from the shuttle valve bias spring 215, to move between the normal mode position and the shutdown mode position. In the normal mode position, which is the position depicted in FIG. 2, the first control pressure port 208 and the second control pressure port 212 are in fluid communication with the first fluid outlet port 218 and the second fluid outlet port 222, respectively. In the shutdown mode position, which is the position depicted in FIG. 3, the reference pressure port 206 is in fluid communication with the first and second fluid outlet ports 218, 222.

To implement its above-described functionality, the compensator valve 204 includes a valve body 224, a valve element 226, and a compensator valve bias spring 225. The valve body 224 includes a first section 228 and a second section 232 of differing cross sectional areas. In particular, the first section 228 has a first cross sectional area, and the second section 232 has a second cross sectional area that is less than the first cross sectional area. The valve body first section 228 is in fluid communication with the mode control valve first and second fluid outlets 218, 222 via, for example, suitable conduits 234, 236, and the valve body second section 232 is in fluid communication with the pump control pressure outlet port 136, the reference pressure port 206, and the first control pressure port 208.

The valve element 226 is movably disposed within the valve body 224, and includes a first spool 238 and a second spool 242. The first spool 238, which has a first diameter, is disposed within the valve body first section 228 and divides the valve body first section 228 into two chambers—a first chamber 244 and a second chamber 246. The first chamber 244 is in fluid communication with the mode control valve first fluid outlet 218, and the second fluid chamber 246 is in fluid communication with the mode control valve second fluid outlet 222. The first spool 238 additionally includes a spring side 248 and a doughnut side 252. The spring side 248 is exposed to fluid pressure in the second chamber 246, and is engaged by the compensator valve bias spring 225. The compensator valve bias spring 225 is disposed in the second chamber 246 and supplies a bias force to the valve element 226 that urges the valve element 226 toward the left, as viewed in FIGS. 2 and 3. The second spool 242, which has a second diameter that is less than the first diameter of the, is disposed within the valve body second section 232. The second spool 242 is coupled to, and is fluidly isolated from, the first spool 238, and more specifically is coupled to the doughnut side 252 of the first spool. With this configuration it may thus be seen that the valve element 226 is responsive to the bias force supplied from the compensator valve bias spring 225, the fluid pressure at the first control pressure port 208, and the fluid pressures in the first and second chambers 244, 246, to cause the pump compensator 110 operate in either the normal mode or the shutdown mode.

Figure 3:
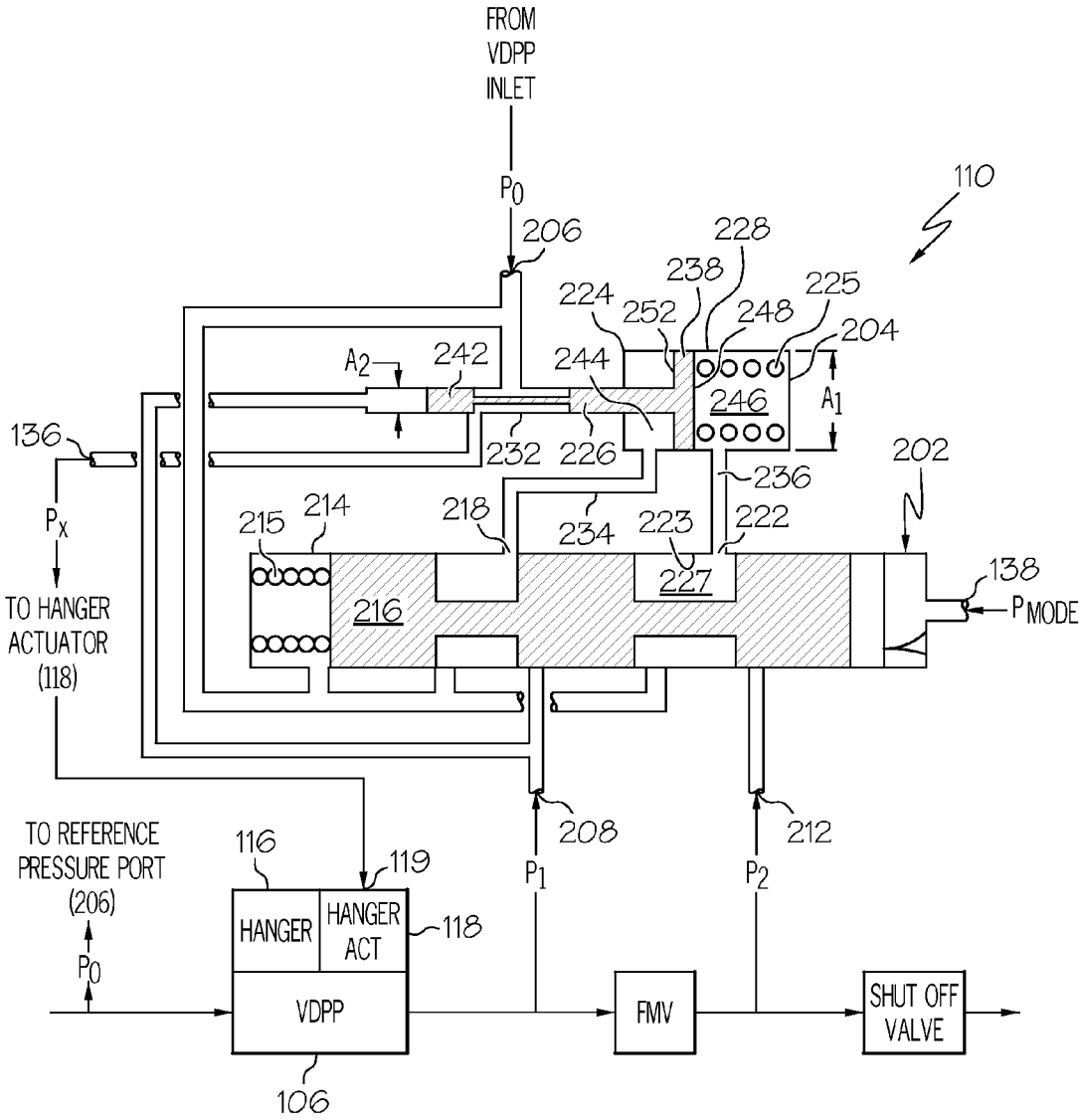
FIG. 3 is a schematic diagram of the exemplary dual mode pump compensator depicted in FIG. 2, but in a shutdown mode.

With continued reference to FIGS. 2 and 3, it is seen that the pump compensator 110 is disposed within the system 100 such that the reference pressure source corresponds to the inlet of the variable displacement piston pump 106. Thus, the reference pressure port 206 is in fluid communication with, and the fluid pressure ($P_0$) at the reference port 206 corresponds to the pressure at, the inlet of the variable displacement piston pump 106. Moreover, the first pump control pressure port 208 is in fluid communication with the metering valve inlet port 124, and the second pump control pressure port 212 is in fluid communication with the metering valve outlet port 126. It may thus be seen that the fluid pressure ($P_1$) at the first pump control pressure port 208 (e.g., the metering valve inlet port 124) is continuously supplied to the compensator valve first spool 238, and the fluid pressure ($P_0$) of the reference pressure source (e.g., the variable displacement piston pump inlet) is continuously supplied to the valve body second section 232 of the compensator valve 204.

It may additionally be seen that the fluid pressures in the compensator valve first and second chambers 244, 246 are set based on the position of the shuttle valve 216. In particular, when the shuttle valve 216 is in the normal mode position (FIG. 2), the fluid pressure ($P_1$) at the first pump control pressure port 208 (e.g., variable displacement piston pump discharge pressure) is supplied to the first chamber 244, and the fluid pressure ($P_2$) at the second pump control pressure port 212 (e.g., the metering valve discharge pressure) is supplied to the second chamber 246. Thus, the pressure differential ($P_1$–$P_2$) between the first and second pump control pressure ports (e.g., the pressure differential across the metering valve) acts across the full diameter of the first spool 238, which maximizes the head regulation sensitivity in the normal mode. With these fluid pressures supplied to, and acting on, the compensator valve 204, the compensator valve 204 controls the fluid pressure ($P_X$) of the pump control fluid such that the pressure differential between the first and second pump control pressure ports ($P_1$–$P_2$), or more specifically the pressure differential across the metering valve 108, is maintained constant (or at least substantially constant). It may thus be appreciated that if, for example, the engine controller 150 commands an increase in fuel flow, an increase in metering valve discharge pressure ($P_2$) will result, and the pump compensator 110 will adjust the position of the hanger 116 so that the pump discharge pressure ($P_1$) automatically increases to maintain the constant differential. Conversely, if the engine controller 150 commands a decrease in fuel flow, a decrease in metering valve discharge pressure ($P_2$) will result, and the pump compensator 110 will adjust the position of the hanger 116 so that the pump discharge pressure ($P_1$) automatically decreases to maintain the constant differential.

As described above, when the system 100 is placed in the shutdown mode, the shutoff valve 122 is moved to the closed position, stopping fuel flow from the metering valve to the combustor 112-1. In addition, the fluid pressure ($P_{MODE}$) at the mode control pressure port 138 is increased to at least a magnitude that allows the shuttle valve 216 to move, against the bias force of the shuttle valve bias spring 215, to the shutdown mode position. As FIG. 3 depicts, when the shuttle valve 216 is in shutdown mode position, the fluid pressure ($P_0$) of the reference pressure source (e.g., the variable displacement piston pump inlet) is supplied to the first and second chambers 244, 246. Thus, the reference pressure ($P_0$) acts on both the spring side 248 and the doughnut side 252 of the first spool 238. With these fluid pressures supplied to, and acting on, the compensator valve 204, the compensator valve 204 controls the fluid pressure ($P_X$) of the pump control fluid such that the pump discharge pressure ($P_1$) is maintained constant (or at least substantially constant). It will be appreciated that the pump discharge pressure ($P_1$) in the shutoff mode may be preset by appropriate selection of the compensator valve diameters. This allows for the provision, if desired, of sufficient internal system pressure to one or more of the other fuel loads 112-2, 112-3, 112-4, . . . 112-N. Moreover, because the flow demand in the shutdown mode would typically be only internal leakages/losses, the flow demand on the variable displacement piston pump 106 would be relatively low. Hence, the variable displacement piston pump 106 will de-stroke to only provide the needed flow to maintain its discharge pressure (P1).

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A fluid supply system, comprising:

a variable displacement piston pump including an adjustable hanger that is movable to a plurality of control positions, the variable displacement piston pump configured to receive a drive torque and, upon receipt of the drive torque, to supply fluid at a pump discharge pressure and flow rate dependent on the control position of the adjustable hanger;

a hanger actuator including a pump control pressure inlet port coupled to receive pump control fluid at a fluid pressure, the hanger actuator responsive to the fluid pressure of the pump control fluid to move the adjustable hanger to a control position; and a pump compensator including a mode control pressure port and a pump control pressure outlet port, the pump compensator pump control pressure outlet port in fluid communication with the hanger actuator pump control pressure inlet port, the pump compensator responsive to fluid pressure at the mode control pressure port to operate in either (i) a normal mode, in which the pump compensator controls the fluid pressure of the pump control fluid such that the variable displacement piston pump is controlled in accordance with a variable flow/variable discharge pressure scheme, or (ii) a shutdown mode, in which the pump compensator controls the fluid pressure of the pump control fluid such that the variable displacement piston pump is controlled in accordance with a variable flow/constant discharge pressure scheme.

2. The system of claim 1, wherein:

the pump compensator further includes a reference pressure port, a first control pressure port, and a second control pressure port;

the pump compensator, in the normal mode, is further responsive to fluid pressure at the first control pressure port and the second control pressure port to control the fluid pressure of the pump control fluid such that a pressure differential between the first control pressure port and the second control pressure port is at least substantially constant; and the pump compensator, in the shutdown mode, is further responsive to fluid pressure at the first control pressure port and the reference pressure port to control the fluid pressure of the pump control fluid such that a pressure differential between the first control pressure port and the reference control pressure port is at least substantially constant.

3. The system of claim 2, further comprising:

a metering valve disposed downstream of the variable displacement piston pump and including a variable area flow orifice; and a metering valve actuator coupled to receive fluid flow commands and operable, in response thereto, to adjust the variable area flow orifice.

4. The system of claim 3, wherein:

the pump compensator, in the normal mode, controls the fluid pressure of the pump control fluid to maintain a substantially constant differential pressure across the metering valve.

5. The system of claim 3, wherein:

the metering valve further includes an inlet port and an outlet port, and the variable area flow orifice disposed between the inlet port and the outlet port;

the pump compensator first control pressure port is in fluid communication with the metering valve inlet port; and the pump compensator second control pressure port is in fluid communication with the metering valve outlet port.

6. The system of claim 2, wherein the pump compensator comprises:

a mode control valve responsive to fluid pressure at the mode control pressure port to move between a normal mode position and a shutdown mode position; and a compensator valve in fluid communication with the mode control valve and operable to control the fluid pressure of the pump control fluid such that:

(i) when the mode control valve is in the normal mode position, the variable displacement piston pump is controlled in accordance with the variable flow/variable discharge pressure scheme, and (ii) when the mode control valve is in the shutdown mode position, the variable displacement piston pump is controlled in accordance with the variable flow/constant discharge pressure scheme.

7. The system of claim 6, wherein the mode control valve comprises:

a valve body including a first fluid outlet port and a second fluid outlet port, and having an inner surface that defines a shuttle valve chamber, the shuttle valve chamber in fluid communication with the mode control pressure port, the reference pressure port, the first control pressure port, the second control pressure port, the first fluid outlet port, and the second fluid outlet port; and a shuttle valve movably disposed within the shuttle valve chamber and responsive to the fluid pressure at the mode control pressure port to move between (i) the normal mode position, in which the first control pressure port and the second control pressure port are in fluid communication with the first fluid outlet port and the second fluid outlet port, respectively, and (ii) the shutdown mode position, in which the reference pressure port is in fluid communication with the first fluid outlet port and the second fluid outlet port.

8. The system of claim 7, wherein the compensator valve comprises:

a valve body including a first section and a second section, the first section having a first cross sectional area, the second section having a second cross sectional area that is less than the first cross sectional area, the valve body first section in fluid communication with the mode control valve first and second fluid outlets, the valve body second section in fluid communication with the pump control pressure outlet port, the reference pressure port, and the first control pressure port; and a valve element movably disposed within the valve body, the valve element comprising:

a first spool disposed within the valve body first section and having a first diameter, the first spool dividing the valve body first section into first and second chambers, the first and second chambers in fluid communication with the mode control valve first and second fluid outlets, respectively, and a second spool coupled to, and fluidly isolated from, the first spool, the second spool having a second diameter that is less than the first diameter, the second spool disposed within the valve body second section, wherein the valve element is responsive to fluid pressure at the first control pressure port, and fluid pressure in the first and second chambers, to operate in either the normal mode or the shutdown mode.

9. The system of claim 3, further comprising:

a boost pump disposed upstream of, and operable to supply a flow of fluid to, the variable displacement piston pump.

10. The system of claim 9 wherein:

the variable displacement piston pump further includes a pump inlet in fluid communication with the boost pump; and the pump compensator reference pressure port is in fluid communication with the pump inlet of the variable displacement piston pump.

11. The system of claim 9, further comprising:

a shut-off valve disposed downstream of the metering valve and movable between an open position and a closed position.

12. The system of claim 11, wherein:

the shut-off valve further includes a position control pressure port that is in fluid communication with the pump compensator mode control pressure port;

the shut-off valve is responsive to fluid pressure at the position control pressure port to move between the open and closed positions;

the pump compensator is in the normal mode when the shut-off valve is in the open position; and the pump compensator is in the shutdown mode when the shut-off valve is in the closed position.

13. A fluid supply system, comprising:

a variable displacement piston pump including an adjustable hanger that is movable to a plurality of control positions, the variable displacement piston pump configured to receive a drive torque and, upon receipt of the drive torque, to supply fluid at a pump discharge pressure and flow rate dependent on the control position of the adjustable hanger;

a hanger actuator including a pump control pressure inlet port coupled to receive pump control fluid at a fluid pressure, the hanger actuator responsive to the fluid pressure of the pump control fluid to move the adjustable hanger to a control position; and a pump compensator including a mode control pressure port and a pump control pressure outlet port, the pump compensator pump control pressure outlet port in fluid communication with the hanger actuator pump control pressure inlet port, the pump compensator responsive to fluid pressure at the mode control pressure port to operate in either a normal mode or a shutdown mode, the pump compensator comprising:

a mode control valve responsive to fluid pressure at the mode control pressure port to move between a normal mode position and a shutdown mode position; and a compensator valve in fluid communication with the mode control valve and operable to control the fluid pressure of the pump control fluid such that:

(i) when the mode control valve is in the normal mode position, the variable displacement piston pump is controlled in accordance with a variable flow/variable discharge pressure scheme, and (ii) when the mode control valve is in the shutdown mode position, the variable displacement piston pump is controlled in accordance with a variable flow/constant discharge pressure scheme.

14. The system of claim 13, further comprising:

a metering valve disposed downstream of the variable displacement piston pump and including an inlet port, an outlet port, and a variable area flow orifice;

a metering valve actuator coupled to receive fluid flow commands and operable, in response thereto, to adjust the variable area flow orifice, wherein the pump compensator, in the normal mode, controls the fluid pressure of the pump control fluid to maintain a substantially constant differential pressure across the metering valve.

15. The system of claim 14, wherein:

the pump compensator further includes a reference pressure port, a first control pressure port, and a second control pressure port, the pump compensator first control pressure port in fluid communication with the metering valve inlet port, the pump compensator second control pressure port in fluid communication with the metering valve outlet port;

the compensator valve, when the mode control valve is in the normal mode position, is further responsive to fluid pressure at the first control pressure port and the second control pressure port to control the fluid pressure of the pump control fluid to maintain the substantially constant differential pressure across the metering valve; and the compensator valve, in the shutdown mode, is further responsive to fluid pressure at the first control pressure port and the reference pressure port to control the fluid pressure of the pump control fluid such that a pressure differential between the first control pressure port and the reference control pressure port is at least substantially constant.

16. The system of claim 14, further comprising:

a boost pump disposed upstream of, and operable to supply a flow of fluid to, the variable displacement piston pump, wherein the variable displacement piston pump further includes a pump inlet in fluid communication with the boost pump, and the pump compensator reference pressure port is in fluid communication with the pump inlet of the variable displacement piston pump.

17. The system of claim 14, further comprising:

a shut-off valve disposed downstream of the metering valve and including a position control pressure port in fluid communication with the pump compensator mode control pressure port, the shut-off valve responsive to fluid pressure at the position control pressure port to move between an open position and a closed position, wherein:

the mode control valve is in the normal mode position when the shut-off valve is in the open position, and the mode control valve is in the shutdown mode position when the shut-off valve is in the closed position.

* * * * *